US006045287A

United States Patent [19]

Busch

[11] Patent Number: 6,045,287

[45] Date of Patent: Apr. 4, 2000

[54] CONNECTING DEVICE OF A BEARING BAR

[75] Inventor: Wolfgang Busch, Hagen, Germany

[73] Assignee: Plettac AG, Plettenberg, Germany

[21] Appl. No.: 09/212,155

[22] Filed: Dec. 15, 1998

Related U.S. Application Data

[63] Continuation of application No. PCT/EP97/03111, Jun. 14, 1997.

[30] Foreign Application Priority Data

Jun. 26, 1996 [DE] Germany ..... 196 25 545

[51] Int. Cl.[7] ..... F16B 7/00

[52] U.S. Cl. ..... 403/49; 403/246; 182/119; 182/179.1; 182/222

[58] Field of Search ..... 63/49, 256, 246, 63/230; 182/179.1, 222, 119; 403/174, 175; 211/182, 192

[56] References Cited

U.S. PATENT DOCUMENTS

| | | | |
|---|---|---|---|
| 3,490,393 | 1/1970 | Nelson | 182/119 |
| 4,039,264 | 8/1977 | Sharp | 403/49 X |
| 4,594,019 | 6/1986 | Maleci et al. | 403/246 |
| 4,599,010 | 7/1986 | Hocking | 403/246 X |
| 5,078,532 | 1/1992 | Williams | 403/49 X |
| 5,560,730 | 10/1996 | Gillard et al. | 403/49 X |
| 5,615,966 | 4/1997 | Jarvis et al. | 403/49 |

FOREIGN PATENT DOCUMENTS

| | | | |
|---|---|---|---|
| 250612 | 1/1988 | European Pat. Off. | 182/222 |
| 29646 | 9/1958 | Finland | 182/222 |
| 2 288 199 | 5/1976 | France . | |
| 1151647 | 7/1963 | Germany | 182/119 |
| 2311199 | 9/1973 | Germany | 182/222 |
| 85 13 985 U | 10/1985 | Germany . | |
| 85 36 459 U | 9/1988 | Germany . | |
| 94 00 646 U | 8/1994 | Germany . | |
| 4319579 | 2/1995 | Germany | 182/222 |

*Primary Examiner*—Harry C. Kim

*Attorney, Agent, or Firm*—Akin, Gump, Strauss, Hauer & Feld, L.L.P.

[57] ABSTRACT

A connecting device is provided for a bearing bar consisting of a tube having such a connecting device at each of its two ends. The connecting device may be used to join horizontal and vertical scaffolding elements. The connecting device consists of a bearing head and a clamping device and is of such a design that its top edge lies in a plane with that of the tube attached thereto. In addition, the connecting device has bolts for a non-positive connection with overlying elements suspendable thereover. These constructional features of the connecting device allow the overlying elements, which have holes or eyelets to be pushed over the bolts of the bearing bar for suspending in the scaffold, to be placed close up to the post elements, so that virtually no gap between the overlying element and the post element is formed. Moreover, the length of the bearing bars may be dimensioned in such a way that frame scaffoldings and modular scaffoldings can be combined as result of an identically adjustable axial spacing of the pair of posts of a modular scaffolding with respect to the axial spacing of a frame scaffolding.

17 Claims, 3 Drawing Sheets

Section A - A
1
2
3
4
5
6
7
8
9
10
11
12
13
A
A

CONNECTING DEVICE OF A BEARING BAR

CROSS REFERENCE TO RELATED APPLICATION

This application is a continuation of International Application PCT/EP97/0311, filed Jun. 14, 1997, published under WO 97/49880, which is incorporated herein by reference.

BACKGROUND OF THE INVENTION

The present invention relates to a connecting device and a bearing bar consisting of a tube having such a connecting device at each of its two ends. The connecting device may be used to join horizontal and vertical scaffolding elements. The connecting device consists of a bearing head and a clamping device and is of such a design that its top edge lies in a plane with that of the tube attached thereto. In addition, the connecting device has bolts for a non-positive connection with overlying elements suspendable thereover. These constructional features of the connecting device allow the overlying elements, which have holes or eyelets to be pushed over the bolts of the bearing bar for suspending in the scaffold, to be placed close up to the post elements, so that virtually no gap between an overlying element and a post element is formed. Moreover, the length of the bearing bars may be dimensioned in such a way that frame scaffoldings and modular scaffoldings can be combined as a result of an identically adjustable axial spacing of the pair of posts of a modular scaffolding with respect to the axial spacing of a frame scaffolding.

With increasing occupational safety regulations, work scaffoldings become more and more important. In addition to rapid assembly, scaffolds are required to meet high safety demands. These requirements are summarized in DIN 4420.

Work scaffoldings are categorized into two types of scaffoldings, the so-called frame scaffoldings and the so-called modular scaffoldings. More specifically, the frame scaffoldings consist of vertical tube framing elements connected with directly stiffening overlying elements and with rail and vertical diagonal braces.

Unlike the above, modular scaffolds have single tubes as vertical posts, which have regularly spaced holding means to suspend bearing bars, as well as longitudinal and diagonal braces. Using the bearing bars which, e.g., have a connecting device according to FR-A-2,288,199, two posts at a time are connected in pairs, and each pair of posts is stiffened in a longitudinal direction by means of longitudinal braces, suspendable overlying elements and diagonals.

Likewise, when suspending the overlying elements, there are primarily two modes of attaching which do not depend on the type of scaffold. In one mode of attaching, the overlying elements have holes or eyelets which are pushed over bolts on the bearing bar, thereby forming a non-positive connection between bearing bar and overlying element. In another mode of attaching, the bearing bar has a preferably continuous groove, into which the hooks or claws attached to the overlying element are suspended to establish connection between the overlying element and the bearing bar.

In addition to safety, the ability of combining both types of scaffolds plays an important role, making arrangements more flexible and allowing complicated constructions to be scaffolded more easily. In this context, it is advantageous to have conformity of the axial spacing of the pair of posts of a modular scaffolding with the fixed axial spacing of the vertical tube framing elements of frame scaffoldings.

To date, such combining capability has only been possible with those scaffoldings where the overlying elements have hooks or claws suspended in the groove of a bearing bar, because in these scaffoldings the axial spacing of the pair of posts of the modular scaffolding may be identical with the axial spacing of the vertical tube framing elements of a frame scaffolding.

With those modular scaffoldings, however, wherein the overlying elements have holes or eyelets pushed over bolts on the scaffold bar in order to be suspended in the scaffold, combining with frame scaffoldings up to now has only been possible using great expenditure, particularly for that reason because the bearing bar, and thus the axial spacing of the pair of posts of the modular scaffolding, had to be larger than the axial spacing of a corresponding frame scaffold. As an additional drawback, a relatively large gap had been formed between the post element and the outer edge of the overlying element, representing a corresponding safety risk.

SUMMARY OF THE INVENTION

Therefore, in a modular scaffolding system wherein the overlying elements have holes or eyelets pushed over bolts on the bearing bar to suspend the overlying elements, the present invention is based on the object of modifying the connecting device of the bearing bar or the bearing bar itself in such a way that a nearly identical axial spacing of the pairs of posts of the modular scaffolding to the axial spacing of the vertical tube framing elements of the frame scaffolding can be achieved, and that the overlying elements can be placed as close as possible to the post elements.

According to the invention, this object is accomplished in such a way that the connecting device, consisting of a bearing head and a clamping device for horizontally extending scaffolding elements having vertical post elements of circular cross-section, is of such a constructional design that the top edge of the bearing head lies in a plane with the top edge of the tube of the horizontally extending scaffold element, which is attached thereto, and that the bearing head has bolts for a nonpositive connection with overlying elements suspendable thereover.

In top view, the bearing head of the invention has the basic shape of a blunt wedge, the exterior surfaces of which form an angle of 22.5° at maximum, preferably 22° or less, relative to the central axis.

According to the invention, the bolts for non-positive connection with the overlying elements are preferably situated on the left and right exterior surfaces of the bearing head in each case.

According to the invention, each of the bolts is preferably flattened and integrated in the bearing head in such a way that the respective exterior surface of the elements will not protrude over the respective exterior surface of the bearing head.

The preferred cross-section of the bolts is illustrated in FIGS. 3*b* and 3*c*. In manufacturing the connecting device, the bolts are preferably integrated in the casting mold.

The connecting device is preferably clamped in the holding means of the post elements, using a wedge.

The invention is also directed to a bearing bar consisting of a tube and a connecting device of the invention at each of the two ends of said tube. The tube preferably has a rectangular cross-section. The connecting device may be screwed, riveted or welded to the tube.

In addition, the tube on its right and left sides has elements for a non-positive connection with the overlying elements, the former being designed as a bolt, preferably having a four-armed star cross-section, i.e., as a so-called star bolt.

Preferably, the overlying elements are floor elements having holes or eyelets.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise arrangements and instrumentalities shown. In the drawings:

FIGS. 1*a*, 1*b* and 1*c* show a side view, a top view and a cross-sectional view, respectively, of a bearing bar according to the invention, including the connecting devices of the invention;

DETAILED DESCRIPTION OF THE INVENTION

Figures 1, 1A, 1B:
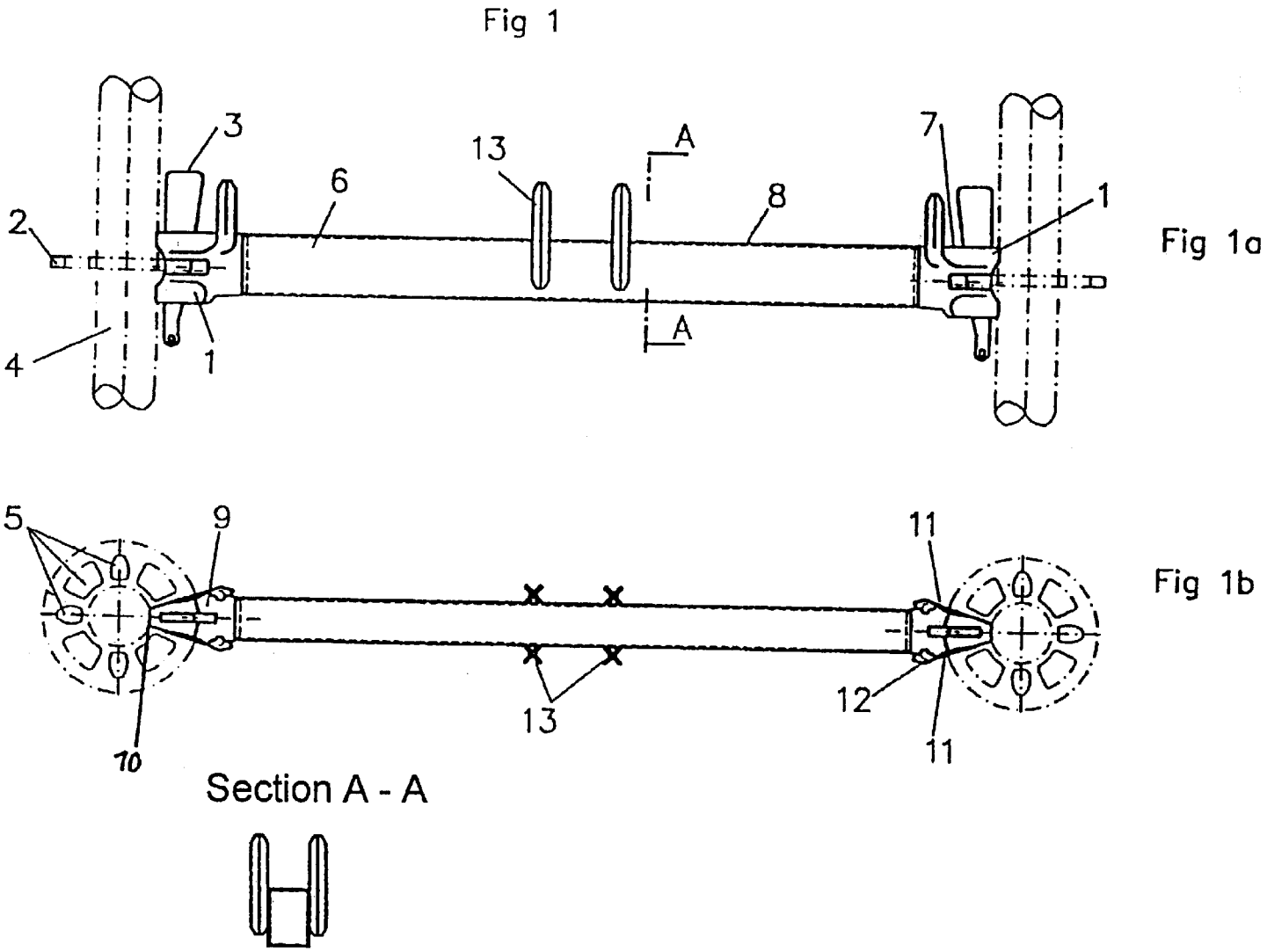

FIG. 1 illustrates the bearing bar according to the invention for two supported floor elements, including the connecting devices of the invention. The bearing head 1 is suspended in a holding means 2 situated at the post element 4 and clamped using a wedge 3 which is pushed through the opening 5. The bearing head 1 is welded to the tube 6 which has a rectangular cross-section. The bearing head 1 is of such a constructional design that its top edge 7 lies in a plane with the top edge 8 of the tube 6 connected thereto. Furthermore, the surface 9 of the bearing head 1 is designed in such a way that, together with the scaffold tube, it forms the supporting surface for supported overlying elements.

Figure 3:
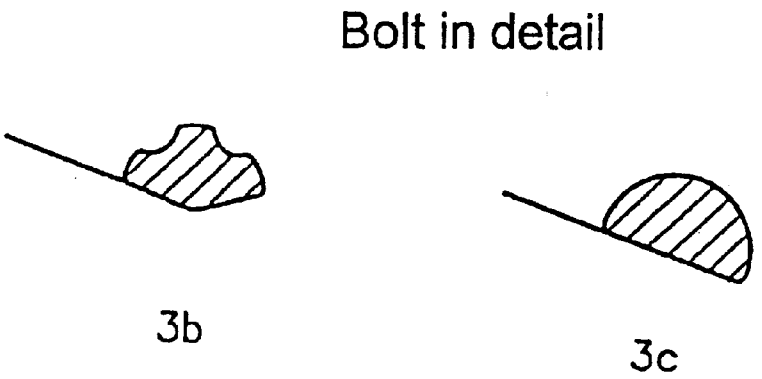
FIG. 3*a* shows two bearing bars according to the invention, arranged on a holding means at an angle of 45°.
FIGS. 3*b* and 3*c* show details of the flattened bolt.
Figure 3A:
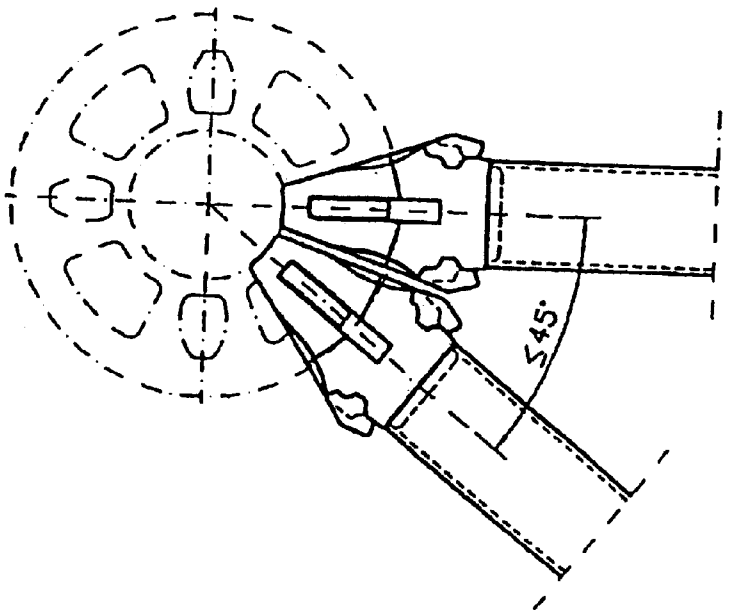

The top view, FIG. 1*b*, demonstrates that the connecting device has a wedge shape, the tip of said wedge being cut off, the area 10 resulting therefrom forming a non-positive connection with the post element 4. The exterior wedge surfaces 11 form an angle of 22°, relative to the central axis, so that it is possible, as illustrated in FIG. 3*a*, to attach two connecting devices of the invention, together forming an angle of 45°, to one single holding means.

The connecting device 1 has bolts 12 allowing the overlying elements supported by tube 6 and said connecting device to be non-positively connected to the latter. In manufacturing the connecting device, the bolts are integrated in the casting mold. As illustrated in FIG. 3*a*, the bolts are flattened at their exterior surfaces in such a way that their exterior surface is in alignment with the exterior wedge surface 11 of bearing head 1. In addition to the star bolts on the connecting head, other star bolts 13 are welded to the tube 6 (see FIG. 1). The star bolts of the connecting device and the tube are in plane.

Figure 2:
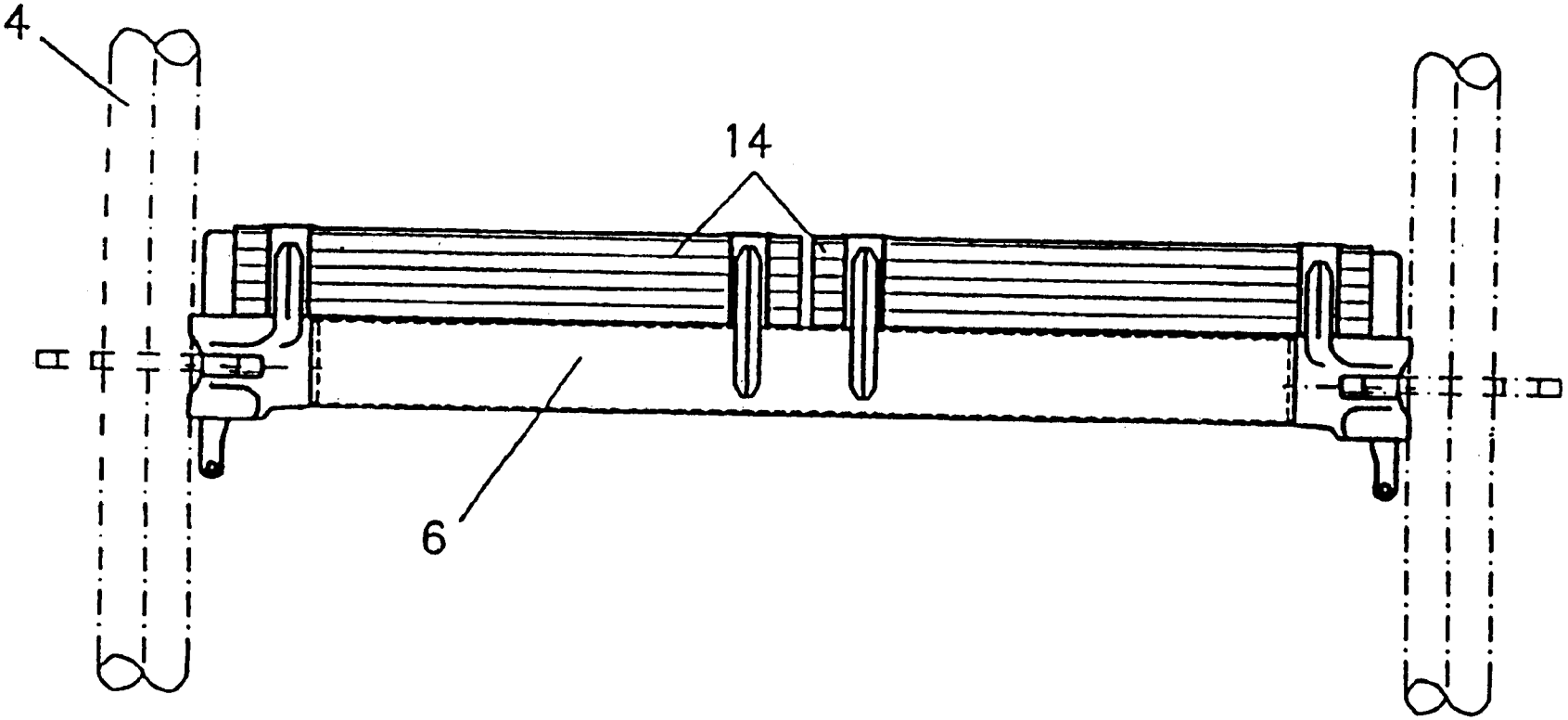
FIG. 2 shows the bearing bar according to the invention, including the connecting devices of the invention with suspended overlying elements.

FIG. 2 shows the way in which two floor elements 14 are placed on the bearing bar. The floor elements are supported both by tube 6 and connecting element 1. At the front side of the standardized floor elements are holes to be pushed over the star bolts 12, 13. As a result of this non-positive connection, the scaffold obtains high horizontal stiffness.

As a result of the fact that the standardized overlying element may also be placed on the connecting element and connected with the same in a non-positive fashion, it is possible to minimize the spacing between the post element 4 and the floor element 14, thereby increasing the safety of working men on the scaffold. Moreover, the length of the bearing bar according to the invention can be designed in such a way as to allow a combination of modular and frame scaffoldings.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

I claim:

1. A connecting device adapted to be mounted to a horizontally extending scaffolding element for engaging a vertical post element (4) having regularly spaced holding means (2), the horizontally extending scaffolding element being capable of supporting at least one overlying floor element, said connecting device comprising:

a bearing head (1) having a top edge (7) and being engagable with the holding means (2) of the vertical post element (4);

a clamping device (3) connecting said bearing head (1) to the holding means (2) and being adapted to secure the horizontally extending scaffolding element (6) to the vertical post element (4);

said top edge (7) being generally co-planar with a top surface (8) of the horizontally extending scaffolding element (6); and a plurality of bolts (12) located on said bearing head (1) and extending upward for releasably securing the at least one overlying floor element with a non-positive connection.

2. The connecting device of claim 1, wherein the plurality of bolts (12) are situated on right and left sides of an exterior surface (11) of the bearing head (1) to obtain the non-positive connection.

3. The connecting device of claim 2, wherein the plurality of bolts (12) each have an exterior surface which is flattened and are integrated in the bearing head (1) such that the respective exterior surface of the bolts does not protrude over the respective exterior surface (11) of the bearing head.

4. The connecting device of claim 3, wherein that the bearing head (1) in top view has a basic shape of a blunt wedge.

5. The connecting device of claim 4, wherein the left and right sides of the exterior surface (11) of said bearing head respectively form an angle of less than 22.5 degrees, relative to a central axis of the bearing head.

6. The connecting device according to claim 1, wherein the bolts (12) form a cast part together with the bearing head (1).

7. The connecting device according to claim 1, wherein the bolts (12) have a cross-section which is a partial circle or a partial star shape.

8. The connecting device according to claim 1, wherein the clamping device (3) is a wedge.

9. A bearing bar, comprising a tube (6) having a connecting device according to claim 1, at each of its two ends.

10. The bearing bar of claim 9, wherein the tube (6) is rectangular in cross-section.

11. The bearing bar according to claim 9, wherein the connecting device (1) is screwed, riveted or welded to the tube (6).

12. The bearing bar according to claim 9, wherein the tube has a second plurality of bolts (13) for non-positive connection between the tube (6) and the overlying floor element (14) which may be placed thereon.

13. The bearing bar according to claim 12, wherein the second plurality of bolts (13) have a cross-section of a four-armed star.

14. A scaffolding system comprising a bearing bar according to claim 9, said bearing bar attached at each end to a separate vertical post element (4) and supporting the at least one overlying floor element (14).

15. The scaffolding system according to claim 14, comprising modular scaffolding.

16. A scaffolding system comprising two of the connecting devices according to claim 1 for connecting the horizontally extending scaffolding element to two of the vertical post elements (4), one of the connecting devices being located at each end of the horizontally extending scaffolding element for connection to the vertical post elements (4).

17. The scaffolding system according to claim 16, comprising modular scaffolding.

* * * * *